US005675916A

United States Patent [19]

Lewis

[11] Patent Number: 5,675,916

[45] Date of Patent: Oct. 14, 1997

[54] SHOE WITH INTERCHANGEABLE HEELS

[75] Inventor: Rosalie Lewis, Los Angeles, Calif.

[73] Assignee: Rose-Lee Beverly Hills, Beverly Hills, Calif.

[21] Appl. No.: 755,698

[22] Filed: Nov. 25, 1996

Related U.S. Application Data

[60] Division of Ser. No. 441,230, May 15, 1995, Pat. No. 5,581,910, which is a continuation-in-part of Ser. No. 431,480, May 1, 1995, which is a continuation of Ser. No. 242,871, May 16, 1994, abandoned, which is a continuation-in-part of Ser. No. 216,067, Mar. 22, 1994, abandoned.

[51] Int. Cl.[6] ..... A43B 21/433

[52] U.S. Cl. ..... 36/36 R; 36/42

[58] Field of Search ..... 36/42, 36 R, 36 A, 36/36 B, 36 C, 41, 43, 44, 100, 136, 71

[56] References Cited

U.S. PATENT DOCUMENTS

| | | |
|---|---|---|
| 511,717 | 12/1893 | Postel et al. . |
| 1,478,144 | 12/1923 | Riccioli . |
| 1,534,540 | 4/1925 | Pezzaniti . |
| 2,795,866 | 6/1957 | Perugia . |
| 2,943,404 | 7/1960 | Sulton . |
| 3,064,367 | 11/1962 | Henatsch . |
| 3,077,680 | 2/1963 | Moustakidis et al. . |
| 3,432,945 | 3/1969 | Cesta . |
| 3,754,340 | 8/1973 | Pais . |
| 4,214,384 | 7/1980 | Gonzalez . |
| 4,219,946 | 9/1980 | Baum . |
| 4,363,177 | 12/1982 | Boros . |
| 4,670,996 | 6/1987 | Dill . |
| 5,058,290 | 10/1991 | Koehl et al. . |
| 5,079,857 | 1/1992 | Clifton . |
| 5,133,138 | 7/1992 | Durcho . |

*Primary Examiner*—Ted Kavanaugh
*Attorney, Agent, or Firm*—Thomas I. Rozsa; Tony D. Chen

[57] ABSTRACT

A shoe with an interchangeable heel. The heel can be interchangeably attached to the heel portion of the outsole of the shoe by extending a large bolt through an opening on the rear portion of the outsole, such that it is threadedly engaged with a sleeve permanently mounted within a recess on top of the heel. A device is provided for anchoring and orientation of the heel.

8 Claims, 5 Drawing Sheets

FIG.8
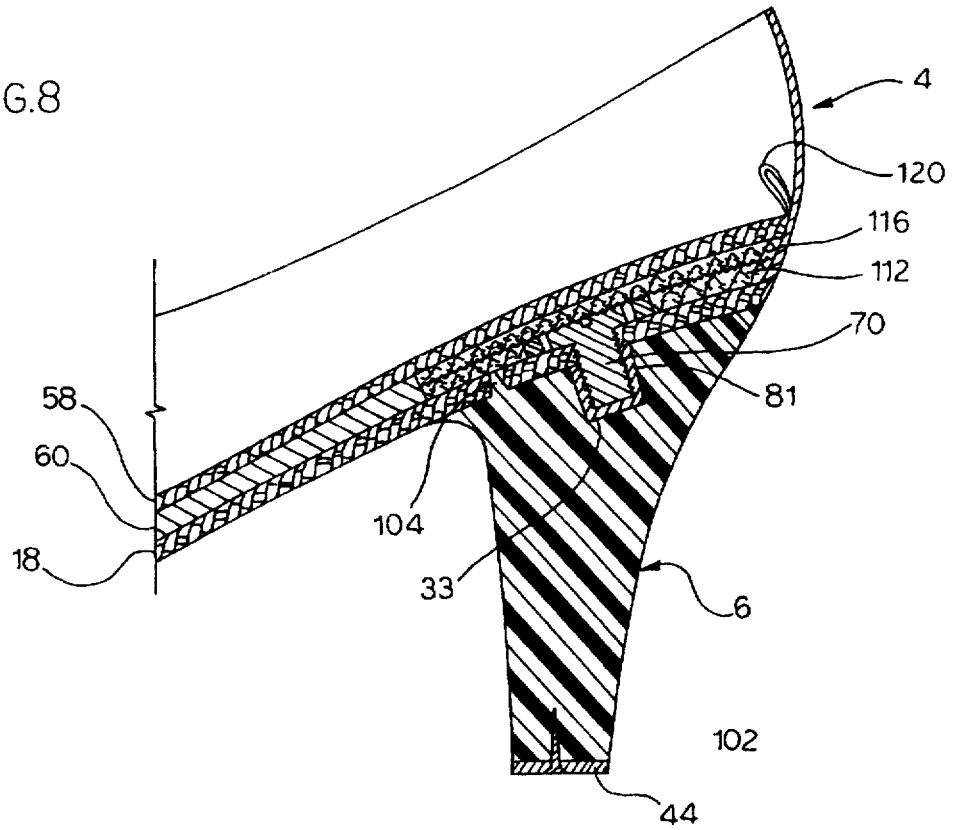
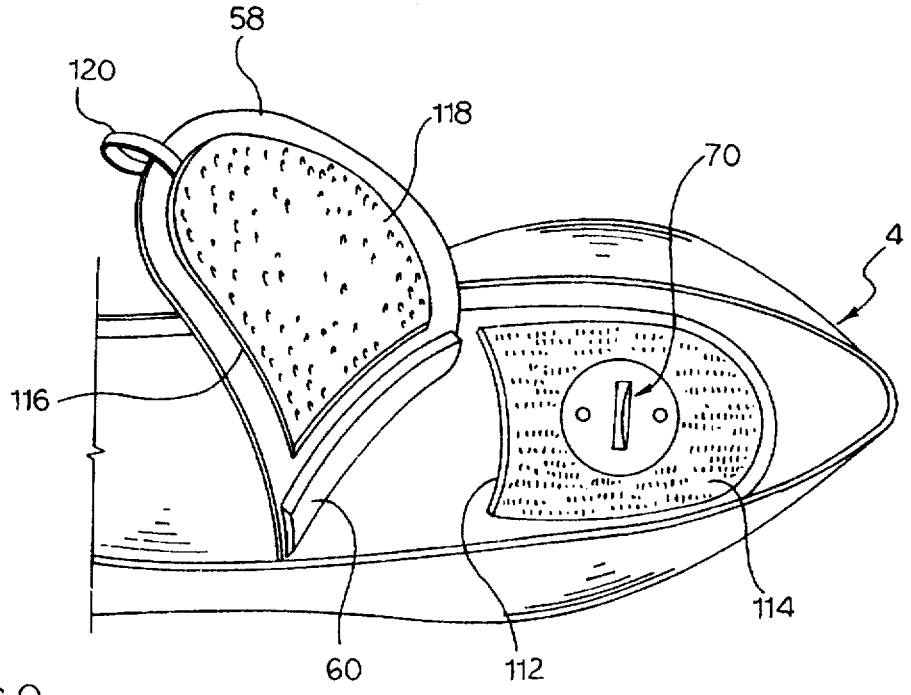
FIG.9

SHOE WITH INTERCHANGEABLE HEELS

This patent application is a Divisional of patent application Ser. No. 08/441,230 filed on May 15, 1995, now U.S. Pat. No. 5,581,910, which is a Continuation-In-Part of patent application Ser. No. 08/431,480 filed on May 1, 1995, now pending, which is a File-Wrapper-Continuance of patent application Ser. No. 08/242,871 filed on May 16, 1994, now abandoned, which is in turn a Continuation-In-Part of patent application Ser. No. 08/216,067 filed on Mar. 22, 1994, abandoned.

BACKGROUND OF THE INVENTION

1. Field of the Invention

The present invention relates to the field of design and construction of shoes. More particularly, the present invention relates to the field of design and construction of interchangeable heels for shoes.

2. Description of the Prior Art

The heels of shoes, particularly the high heels of women's shoes, are extremely fragile and can be damaged easily. When the heel is damaged, it is often very expensive to have it repaired. In addition, it is strenuous to walk long distances in high heels. Many businesswomen prefer to have low-heeled shoes for walking and then wear the high heel shoes during work. At present, this requires the women to have two sets of shoes; a pair of low heel shoes for walking and a pair of high heel shoes for wear during work. Making the heels interchangeable is one way to solve this problem.

The following eleven (11) prior art patents were uncovered in the pertinent field of the present invention which relates to the design and construction of interchangeable heels.

1. U.S. Pat. No. 2,795,866 issued to Perugia on Jun. 18, 1957 for "Ladies' Shoes" (hereafter "the Perugia Patent").

2. U.S. Pat. No. 3,064,367 issued to Henatsch on Nov. 20, 1962 for "Replacement Heel Structure" (hereafter "the Henatsch Patent").

3. U.S. Pat. No. 3,077,680 issued to Moustakidis el al. on Feb. 19, 1963 for "Removable Shoe Heel" (hereafter "the Moustakidis Patent").

4. U.S. Pat. No. 3,432,945 issued to Cesta on Mar. 18, 1969 for "Replaceable Heels For Shoes" (hereafter "the Cesta Patent").

5. U.S. Pat. No. 3,754,340 issued to Pais on Aug. 28, 1973 for "Devices For Attaching Heels To Shoe Soles" (hereafter "the Pais Patent").

6. U.S. Pat. No. 4,214,384 issued to Gonzalez on Jul. 29, 1980 for "Replaceable Heel Construction For Shoes" (hereafter "the Gonzalez Patent").

7. U.S. Pat. No. 4,363,177 issued to Boros on Dec. 14, 1982 for "Style Convertible Footwear" (hereafter "the Boros Patent").

8. U.S. Pat. No. 4,670,996 issued to Dill on Jun. 9, 1987 for "Women's Shoes With Flexible Spring Steel Shanks For Use With Replaceable Heels of Different Height" (hereafter "the Dill Patent").

9. U.S. Pat. No. 5,058,290 issued to Koehl et al. on Oct. 22, 1991 for "Shoe Construction With Self Seating Removable Heel" (hereafter "the Koehl Patent").

10. U.S. Pat. No. 5,079,857 issued to Clifton on Jan. 14, 1992 for "Shoe Having A Detachable Heel" (hereafter "the Clifton Patent").

11. U.S. Pat. No. 5,133,138 issued to Durcho on Jul. 28, 1992 for "Replaceable High Heel" (hereafter "the Durcho Patent").

The Perugia Patent discloses a ladies' shoe having a replaceable heel. The heel is provided with a metal tenon curved along a circular arc in the direction of its length. The insole of the shoe is a mortise slide which is curved with the same radius of curvature as the tenon and the inside section of which corresponds to that of the tenon. To mount the heel to the shoe, the tenon engages in the mortise slide and is pushed until the heel comes against the extreme edge of the sole. To disengage the heel from the shoe, the heel is pulled towards the outside. The Perugia Patent also teaches an assortment of heels of different shapes, styles and colors.

The Henatsch Patent discloses a replaceable heel structure. The heel consists of two portions. The first portion is a tread-retaining portion which is attached to the bottom of the sole, and the second portion is the tread portion which is slidably attached to the tread-retaining portion. The Henatsch Patent is designed with a flat heel.

The Moustakidis Patent discloses a removable shoe heel. The heel assembly is permanently attached to the base plate of the shoe.

The Cesta Patent discloses a replaceable heel construction for shoes. The heel base carries a latch plate with rear and front openings having marginal tongues, the rear tongues being inclined and providing fulcrums and guides and the front tongues being upright and providing guides.

The Pais Patent discloses an apparatus for coupling a shoe heel to a shoe. It includes an elongated plate used as a shank which extends up to and adjacent the sole back end.

The Gonzalez Patent discloses a replaceable heel construction for shoes. A coupling element is positioned to receive wings of another coupling element. Upon full insertion of the wings in the slot of the coupling element, flanges will underlay the wings, the slot conforms to the configuration of the wings, and a resilient locking tab will snap-down into a locking groove.

The Boros Patent discloses convertible footwear. A detachably attachable heel is secured adjacent the heel portion of the sole by lock means which include a threaded stud for threadedly engaging a cavity within the sole.

The Dill Patent discloses a woman's shoe with flexible shank for use with replaceable heels of different sizes. It includes an elongated flexible spring steel shank which is nestled within a slot between the insole and sole and anchored at one end. A high heel registers with the heel portion and interlocking fasteners. Upon limited rotation of the heel relative to the shoe, it removably anchors the heel upon the shoe. The heel upon limited angular rotation and disengagement of the fasteners is adapted for removal and replacement by a low heel having similar fasteners. The shank moves within the slot to compensate for the change in height. The interlocking fasteners include opposed interconnected lock segments and anchor flanges secured to the heel and heel portion respectively. An alignment pin in the heel projects into an alignment opening in the sole preventing relative rotation of the heel and heel portion to prevent disengagement of the segments and flanges.

The Koehl Patent discloses a shoe construction with a self-seating removable heel. A high heel is removably attached to the shoe and has an enlarged upper end portion with an inclined upper surface carrying a dovetail locking member that extends upwardly from the high heel upper end portion inclined surface. The locking member includes a pedestal with a dove-tail sidewall that corresponds to and registers with the socket so that the heel can be attached to the socket by moving the heel pedestal into the socket in a fore to aft direction. The pedestal and socket are thus loaded during normal use of the shoe, so that during walking, the heel pedestal is continuously forced rearwardly into the socket.

The Clifton Patent discloses a shoe having a detachable heel. The shoe includes a foot receptacle portion having a threaded stem extending downwardly from a heel plate fixedly attached to the bottom of the foot receptacle portion which selectively receives a shoe heel in threaded engagement. A spring-biased locking pin is disposed in the shoe heel which engages a locking pin slot formed in the heel plate of the foot receptacle portion.

The Durcho Patent discloses a replaceable high heel. The device is an improved shoe which includes a shoe having an upper, a sole, a block extending downwardly from the lower portion of the sole adjacent to the heel, and a magnetic plate facing downwardly from the block. An improved replaceable heel includes an upper surface with an upwardly facing recess and a magnetically responsive plate which faces upwardly on the lower surface of the recess.

One of the problems of the prior art interchangeable heels is that they often have very complicated structures. This often increases the manufacturing costs and therefore the price of the shoes. Another problem of the prior art interchangeable heels is that they are often hard to handle, some even requiring a tool to detach the heel. A further problem of the prior art interchangeable heels is that they are not durable. In most prior art design and construction, the mating members between the outsole and the heel are part of the structure of the heel or the outsole of the shoe. Therefore, the strength and durability of the mating members are limited by the properties of the materials used for the construction of the heel or the outsole of the shoe.

It is desirable to design and construct shoes with interchangeable heels which are easy to handle, durable and inexpensive to manufacture.

SUMMARY OF THE INVENTION

The present invention is a shoe with an interchangeable heel.

It is known that the heel of a shoe, particularly the high heel of a woman's shoe, is the part that most likely be damaged, and repairing a shoe with a damaged heel is often very expensive. Therefore, shoes with interchangeable high heels have been developed. With an interchangeable high heel, if the heel is damaged, then the heel can be simply replaced with a new heel, and the shoe can be worn again.

It is further known that it is more comfortable for a woman to walk in low-heeled shoes rather than high heels. For working women who need to wear high heels with a business suit or dress during work, and who also have to walk a long distance from their car or public transportation to their place of work, it is often necessary for them to carry two pairs of shoes: low-heeled shoes to walk and high-heeled shoes to wear during work. By having interchangeable heels, the low-heeled shoes could be worn during the long walk and then an interchangeable high heel could be used during work. In this way, the same shoe can be used and it eliminates the necessity of carrying an extra pair of shoes.

It has been discovered, according to the present invention, that if the attachment between the outsole of a shoe and the heel of the shoe is established through a large threaded bolt which extends through an opening on the interior bottom surface of the shoe and is threadedly engaged with a threaded opening on top of the heel, then the outsole and heel can be made of normal materials such as those used for conventional shoes, while the bolt can withstand the stress and impact at the conjunction of the outsole and the heel.

It has also been discovered, according to the present invention, that if the attachment between the outsole of a shoe and the heel of the shoe is further established by a small threaded screw which also extends through another opening at the interior bottom surface of the shoe and if a threaded cylindrical sleeve is threadedly engaged from the exterior bottom surface of the shoe with the small threaded screw, then the cylindrical sleeve can be inserted into another opening on the heel to provide an orientation pin for the interchangeable heel and also provides an anti-rotation means so that the heel will not rotate during use.

It has further been discovered, according to the present invention, that if a large threaded bolt has a widened disk-shaped top and a semi-circular shaped ring handle which is hingeably attached to it, the disk and ring handle being accessible from the inside of the shoe, then a user can lift up the ring handle and hold it to rotate the large threaded bolt to unscrew it, so that the heel can be removed.

It has additionally been discovered, according to the present invention, that by utilizing a rigid washer which is shaped similar to the rear of the shoe where the large threaded bolt extends through the shoe, then the large threaded bolt can be rigidly secured inside the shoe.

It has also been discovered, according to the present invention, that by utilizing a flexible cushion which is shaped similar to the rear of the shoe and is designed to be flush with the widened disk-shaped top of the large threaded bolt, then a user will not feel the hingeably attached ring handle when wearing the shoe.

It is therefore an object of the present invention to provide a shoe with an interchangeable heel, where the attachment between the outsole of a shoe and the heel of the shoe is established through a large threaded bolt which extends through an opening on the interior bottom surface of the shoe and is threadedly engaged with a threaded opening on top of the heel, so that the outsole and heel can be made of normal materials such as those used for conventional shoes, while the large threaded bolt is made of metal which can withstand the stress and impact at the juncture of the outsole and the heel.

It is also an object of the present invention to provide a shoe with an interchangeable heel, where the attachment between the outsole of a shoe and the heel of the shoe further includes a small threaded screw which also extends through another opening at the interior bottom surface of the shoe and a threaded cylindrical sleeve is threadedly engaged from the exterior bottom surface of the shoe with the small threaded screw and the cylindrical sleeve is inserted into another opening at the top of the heel, so that the cylindrical sleeve provides an anchor or orientation pin for the interchangeable heel and also serves to stabilize the heel so that it will not rotate during use.

It is a further object of the present invention to provide a shoe with an interchangeable heel, where the large threaded bolt has a widened disk-shaped top and a semi-circular shaped ring handle which is hingeably attached to it, the disk and ring being accessible from inside the shoe, so that a user can lift up the ring handle and hold it to rotate the bolt to unscrew it and to remove the heel from the shoe.

It is an additional object of the present invention to provide a shoe with an interchangeable heel, where the large threaded bolt utilizes a rigid washer which is shaped similar to the rear of the shoe, so that the bolt can be rigidly secured inside the shoe.

It is still a further object of the present invention to provide a shoe with an interchangeable heel, where the large threaded bolt further utilizes a flexible cushion which is shaped similar to the rear of the shoe and placed flush with the widened disk-shaped top of the large bolt, so that a user will not feel the hingeably attached ring handle when wearing the shoe.

Described generally, the present invention is a shoe with an interchangeable heel. The shoe has an outsole having a heel portion with an exterior bottom surface. The heel portion of the shoe has a wide opening and a narrow opening, and a heel having a top surface and a front side, the top surface having a wide threaded opening and a narrow opening. The heel is interchangeably attached to the outsole by a large threaded bolt and an orientation pin.

The heel can be interchangeably attached to the heel portion of the outsole by extending a large threaded bolt through the wide opening on the interior bottom surface of the shoe and being threadedly engaged with the wide threaded opening on top of the heel. A small threaded screw also extends through another opening on the interior bottom surface of the shoe such that a threaded cylindrical sleeve is threadedly engaged from the exterior bottom surface of the shoe onto the small threaded screw, so that the cylindrical sleeve can be inserted into a second opening in the heel to permit the cylindrical sleeve to act like an anchor or orientation pin for the heel so that the heel will not rotate during use.

The large threaded bolt has a widened disk-shaped top and a semi-circular shaped ring handle which is hingeably attached to it and is accessible from the interior of the shoe, so that a user can lift up the ring handle and hold it to rotate the large threaded bolt to unscrew it so that the heel can be removed from the interior of the shoe.

A rigid washer is provided and is shaped similar to the rear of the shoe where the large threaded bolt extends through the shoe, so that the large threaded bolt can be rigidly secured inside the shoe.

A flexible cushion is also provided with the present invention and is shaped similar to the rear of the shoe and placed flush with the widened disk-shaped top of the large threaded bolt, so that a user will not feel the hingeably attached ring handle when wearing the shoe.

In still another embodiment of the present invention, the large threaded bolt has a widened disk-shaped top with a horizontal narrow dent and two small opposite holes. The horizontal narrow dent is located between the two small holes such that each hole is located on opposite sides of the horizontal narrow dent. The large threaded bolt is accessible from the interior of the shoe, so that a user can use a key with two prongs which correspond with the two small opposite holes on the widened disk-shape top. The key is utilized like a conventional screwdriver by turning the large threaded bolt to screw or unscrew it so that the heel can be mounted or removed from the shoe. The large threaded bolt can also be screwed or unscrewed by inserting a coin, for example a penny, to the horizontal narrow dent on the widened disk-shape top.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 8 is a partial cross-sectional view of the shoe with the interchangeable heel assembled.

FIG. 9 is a partial top plan view of the shoe with the large threaded bolt screwed onto the rear of the shoe.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a shoe with an interchangeable heel. The essential part of the present invention is a large threaded bolt, a small threaded screw, a threaded cylindrical sleeve, a rigid washer, and a flexible cushion.

Figure 1:
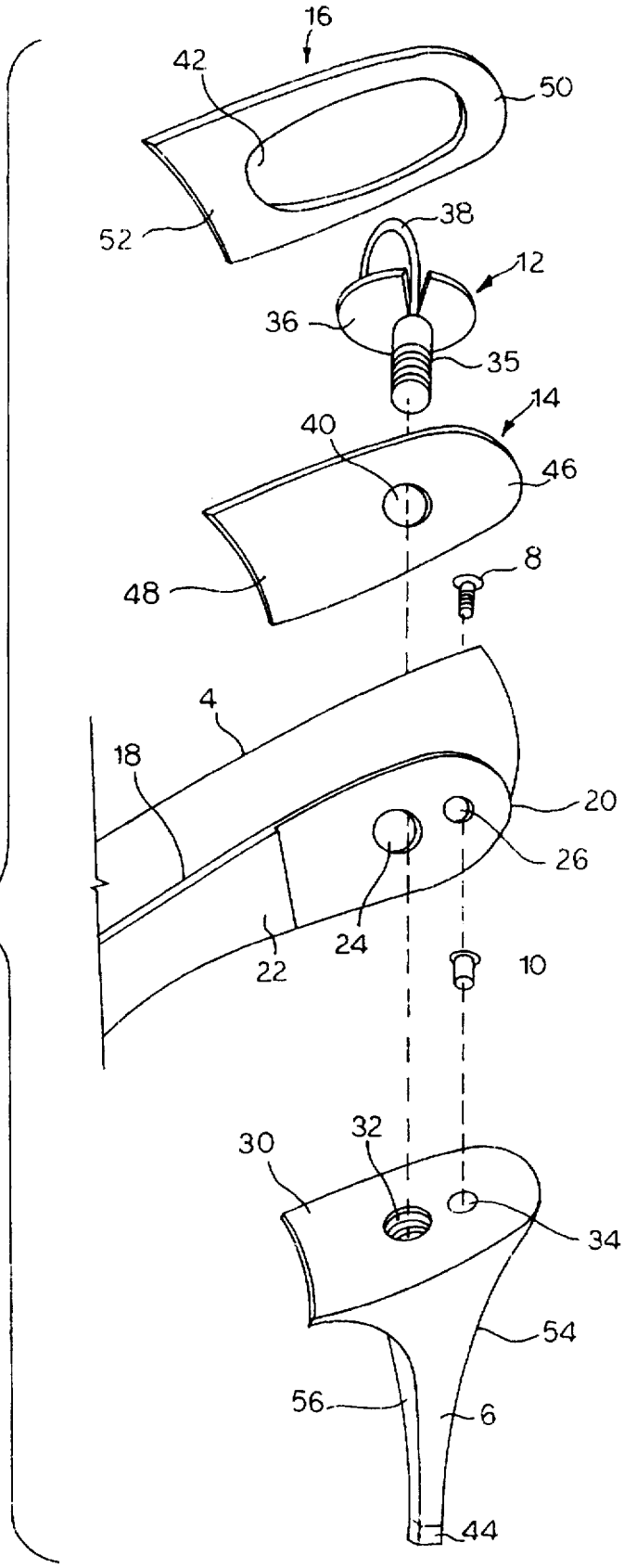
FIG. 1 is an exploded perspective view of the shoe with the interchangeable heel.
Figure 2:
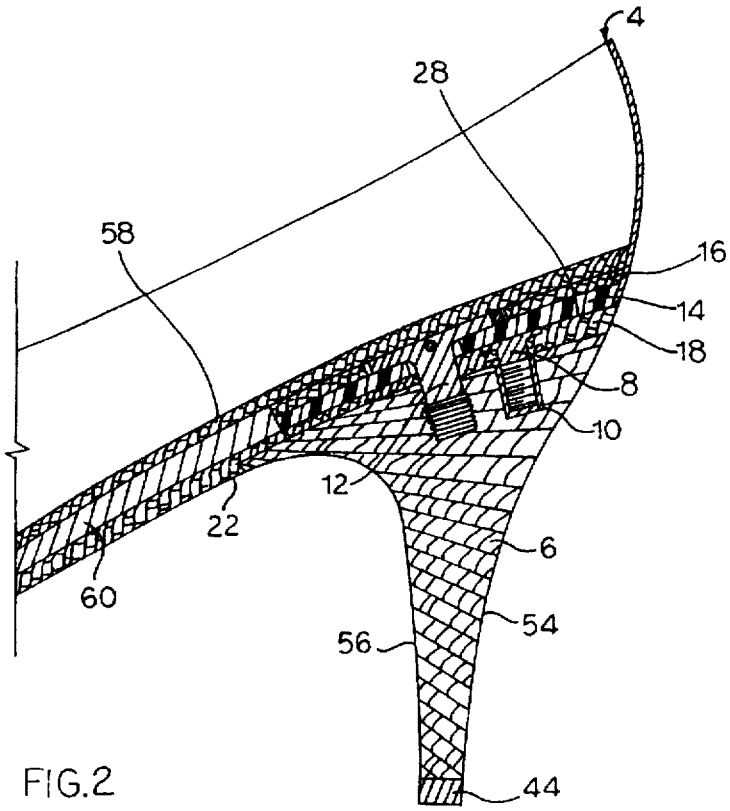
FIG. 2 is a partial cross-sectional view of the shoe with the interchangeable heel assembled.
Figure 3:
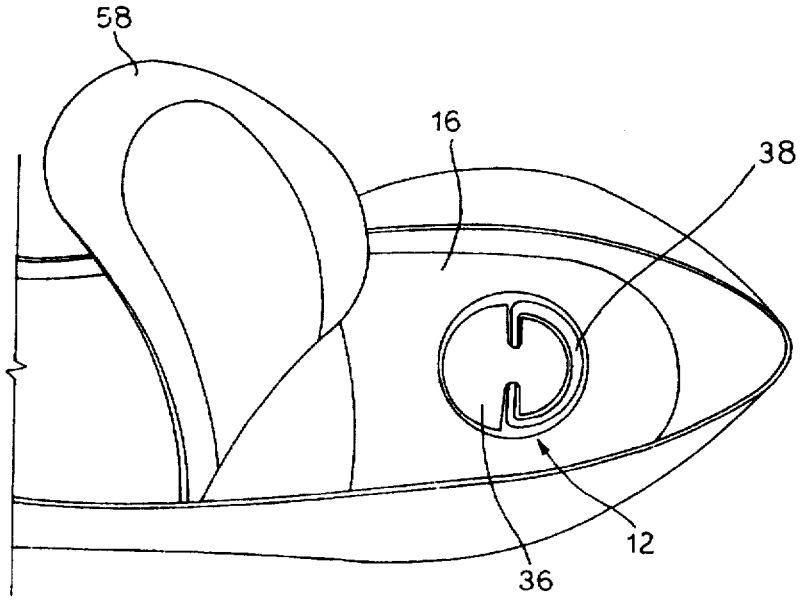
FIG. 3 is a partial top plan view of the shoe with the large threaded bolt screwed onto the rear of the shoe.

FIG. 1 shows an exploded perspective view of the present invention shoe 4 with an interchangeable heel 6. Referring to FIGS. 1, 2 and 3, the present invention consists of the shoe 4, interchangeable heel 6, a small threaded screw 8, a threaded cylindrical sleeve 10, a large threaded bolt 12, a rigid washer 14, and a resilient cushion or pad 16. The shoe 4 has an outsole 18 which has a heel portion 20 with an interior bottom surface 28 (shown in FIGS. 2 and 3) and an exterior bottom surface 22. The heel portion 20 further has a pair of openings 24 and 26 which are aligned with and adjacent to each other.

Referring to FIGS. 1 and 3, the interchangeable heel 6 has a top surface 30, a bottom tip 44, a front side 56 and a curved rear surface 54. The top surface 30 has a wide threaded opening 32 and a narrow opening 34. These openings 32 and 34 are located in correspondence with the two openings 24 and 26 on the heel portion 20 of the outsole 18. The interchangeable heel 6 is attached to the heel portion 20 of the outsole 18 of the shoe 4 such that the exterior bottom surface 22 abuts the top surface 30 of the interchangeable heel 6, as shown in FIG. 2.

Referring to FIGS. 1 and 2, the large bolt 12 has a threaded shaft 35, a widened disk-shaped top 36 and a semi-circular shaped ring handle 38 which is hingeably attached to the widened disk-shaped top 36, so that a user can lift up the ring handle 38 and hold it to rotate the bolt 12 to unscrew it from the heel 6 so that the heel 6 can be removed from the shoe 4.

The small threaded screw 8 is inserted into the opening 26 on the shoe 4 from the inside and threadedly engaged with the threaded cylindrical sleeve 10 from the outside of the shoe 4. The cylindrical sleeve 10 is inserted into the narrow opening 34 at the top of the heel 6, so that the cylindrical sleeve 10 provides an anchor or orientation pin for the heel 6. This allows the heel portion 20 to be aligned with the heel 6 and also stabilizes the heel 6 from rotating during use once the heel 6 is mounted to the heel portion 20.

The rigid washer 14 has a central opening 40, a curved end 46 and a straight end 48. The washer 14 has a shape covering the interior of the shoe at the center of the rear of the heel portion 20 of the outsole 18 to provide a snug fit in the rear of the shoe 2. The washer 14 is preferably made of plastic. It may also be made of metal material or other suitable materials. The washer 14 is placed inside the shoe 4 adjacent to the rear of the heel portion 20 of the outsole 18. The opening 40 of the washer 14 is aligned with the wide opening 24 on the heel portion 20. The washer 14 is sandwiched between the widened disk-shaped top 36 of the large bolt 12 and the interior bottom surface 28 of the shoe 4 for providing a rigid support between the bolt 12 and the interior bottom surface 28. The large bolt 12 utilizes the washer 14, so that the screw 12 can be rigidly secured inside the shoe 4.

The flexible cushion 16 has a central wide circular opening 42, a curved end 50 and a straight end 52. The cushion 16 is shaped similar to the washer 14 and is utilized for padding the rear of the heel portion 20. The cushion 16 is preferably made of felt material or any suitable foam-type of materials. The cushion 16 is placed inside the shoe 4 where the wide circular opening 42 surrounds and is flush with the widened disk-shaped top 36 of the large bolt 12, as shown in FIG. 2, so that a user can not feel the hingeably attached ring handle 38 when wearing the shoe.

The heel 6 can also be interchangeably detached and replaced by lifting up the insole 58 and also the ring handle 38, thereby rotating the ring handle 38 counterclockwise to separate the heel 6 from the shoe 4.

Referring to FIG. 2, to assemble the shoe 4 with the interchangeable heel 6, the padding 60 is cut to size such that the washer 14 and the cushion 16 can be placed at the rear of the shoe. First, the small screw 8 is placed inside the shoe above the interior bottom surface 28 and extending through opening 26 and thereafter threadedly engaged with the interior threaded cylindrical sleeve 10. The heel 6 is placed against the bottom of the outsole 18 so that the sleeve 10 is inserted into opening 34 of the heel 6. The washer 14 is then placed inside the shoe on top of the interior bottom surface 28 so that opening 40 of the washer 14 is aligned with opening 24 of the shoe 4. The threaded bolt 12 is then placed over the washer 14 such that threaded shaft 35 is inserted through opening 40 of the washer 14, through opening 24 of the shoe and into threaded opening 32 of the heel 6. The semi-circular ring shaped handle 38 is then lifted up from the widened disk-shaped top 36 so that the ring handle 38 can be rotated in a clockwise direction until the threaded shaft 35 is entirely screwed into the threaded opening 32 of the heel 6 so that the heel 6 is securely affixed to the shoe 4. The widened disk-shaped top 36 then fits flush against the top of the washer 14. The ring handle 38 is then pushed back so that it lies flat against the widened disk-shaped top 36 and adjacent the washer 14. The cushion 16 is then placed inside the shoe and on top of the washer 14 so that the cushion 16 surrounds the widened disk-shaped top 36 and the ring handle 38 which fit through opening 42 and provide an even surface so that the disk-shaped top 36 and ring handle 38 do not protrude above the cushion 16. Finally, the insole 58 is positioned downwardly inside the shoe 4 so that it covers the padding 60 and also removably covers the cushion 16, the disk-shaped top 36 and ring handle 38.

As illustrated in FIG. 3, when one desires to remove the heel and replace it with a substitute heel, the insole 58 is lifted away from the interior rear portion of the shoe so that the widened disk-shaped top 36 and semi-circular shaped ring handle 38 are exposed. The ring handle 38 is then lifted up and rotated in a counterclockwise direction until the threaded shaft 35 has been unscrewed from the threaded opening 32 in the heel. At that point a substitute heel which also contains identical openings 32 and 34 is placed against the lower portion of the outsole 18 of the shoe so that sleeve 10 fits into opening 34 and thereafter the ring handle 38 is rotated again in a clockwise direction so that threaded shaft 35 is screwed into threaded opening 32 of the replacement heel. After the threading operation has been completed, the ring handle 38 is again caused to lay flat adjacent the widened disk-shaped top 36 and against the washer 14 and thereafter the insole 58 is pushed back over the assembly so that it is once again concealed and so that the shoe can be plaid onto a woman's foot so that she can walk on it without feeling the widened disk 27 shaped top 36 and semi-circular shaped ring handle 38 due to the cushion 16 which causes all of this assembly to be flush and not have a protruding surface to abut against the lower portion of the insole 58. In this way, any time a woman wishes to replace the heel, the heel can be replaced with a substitute heel either of a different color or of a different size.

Figure 4:
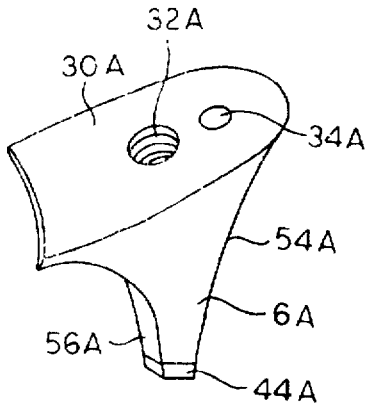
FIG. 4 is a perspective view of a second interchangeable heel.

Referring to FIG. 4, there is illustrated smaller different sized heel which has the same upper surface 30A as heel 6 which has surface 30. With respect to the substitute heel 6A, all of the parts are comparable to the heel 6 except that it illustrates a shorter heel for walking purposes. The smaller heel 6A has a top surface 30A, a bottom tip 44A, a front side 56A and a curved rear surface 54A. The top surface 30A has a wide threaded opening 32A and a narrow smooth opening 34A. The openings 32A and 34A are located in correspondence with the two openings 24 and 26 on the heel portion of the outsole 18, as shown in FIG. 1. When one desires to remove the high heel 6 and substitute therefor a lower walking heel 6A, once again as illustrated in FIG. 3, the rear portion of the insole 58 is lifted away from the present invention assembly so that the widened disk-shaped top 36 and the semi-circular ring handle 38 are exposed. The ring handle 38 is then lifted up and rotated in a counterclockwise direction until the threaded shaft 35 has been removed from the threaded opening 32 and thereafter the heel 6 is moved away from the shoe and the substitute heel 6A is placed against the outsole 18 so that the cylindrical sleeve 10 fits into opening 34A and then ring handle 38A is rotated in the clockwise direction so that threaded shaft 35 extends into threaded opening 32A until the substitute heel 6A is securely affixed to the shoe. Thereafter once again, the ring handle 38 is caused to lie flush with the widened disk-shaped top 36 so that the ring handle 38 is flush with the top and also lies against the washer 14 and thereafter the insole 58 is placed over the assembly to cover it so that the shoe can be worn.

The shoe 4 conforms to conventional forms of manufacture and is easy to use. The shoe 4 can be made of normal materials such as those used for conventional shoes, while the large bolt 12 is made of metal which can withstand the stress and impact at the juncture of the outsole 18 and the heel 6.

The figures have illustrated a high heel and a lower heel. It will be appreciated that the shoe can be attached to several different heels to be worn with the same shoe, such as a medium heel, a high heel or a low walking heel. The interchangeable feature therefore permits the same shoe to be worn with many different types of heels for different uses and can also be used to replace a broken heel.

Figure 5:
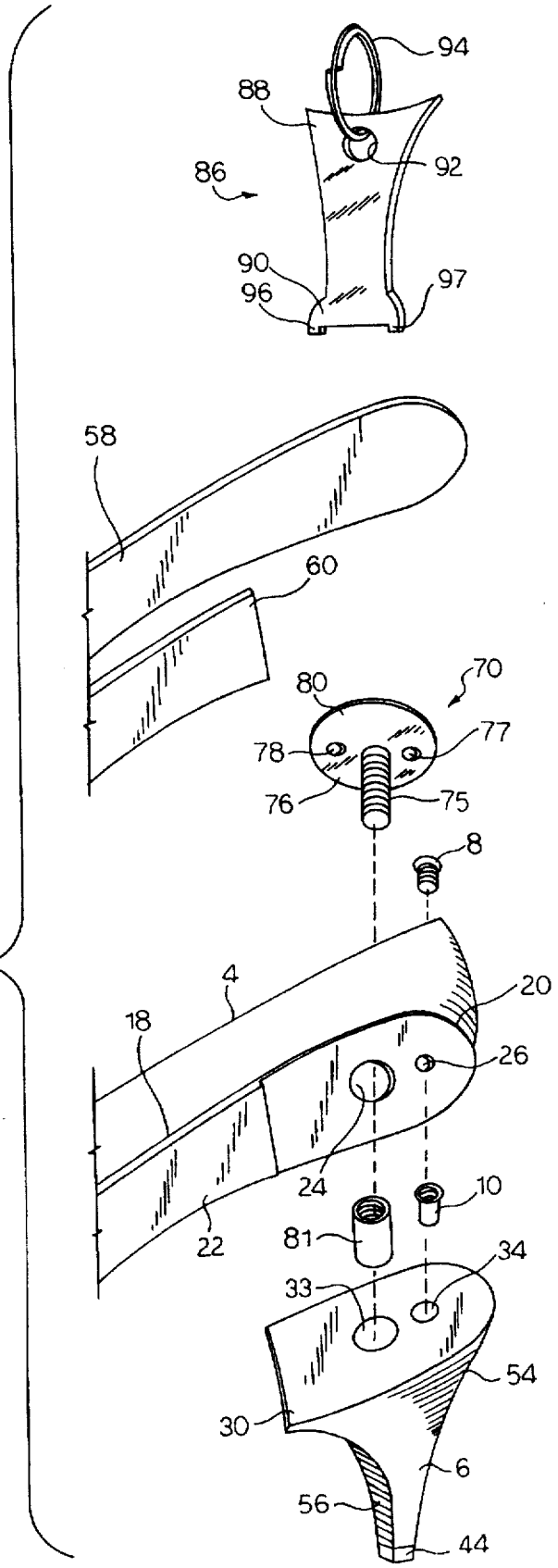
FIG. 5 is an exploded perspective view of another embodiment of the shoe with the interchangeable heel.

FIG. 5 shows an exploded perspective view of another embodiment of the present invention shoe 4 with an interchangeable heel 6. Since some of the components are the same as previously described above, their reference numbers will continue to be used, and only the modified components will be described in detail and new reference numbers will be used for the modified components. This embodiment is similar to the previously described embodiment above except that another large threaded bolt 70 is substituted for the large threaded bolt 12 shown in FIGS. 1, 2 and 3.

Referring to FIG. 5, there is shown another embodiment of the present invention which consists of the shoe 4, interchangeable heel 6, a small threaded screw 8 which is threadedly engaged with a cylindrical sleeve 10, the large bolt 70 which is threadedly engaged with a complementary cylindrical sleeve 81 which is permanently affixed in hole 33 of the heel 6. The shoe 4 has an outsole 18 which has a heel portion 20 with an interior bottom surface and an exterior bottom surface 22. The heel portion 20 further has a pair of openings 24 and 26 which are aligned with and adjacent to each other.

The interchangeable heel 6 has a top surface 30, a bottom tip 44, a front side 56 and a curved rear surface 54. The top surface 30 has a wide opening 33 and a narrow opening 34 and are aligned with and adjacent to each other. These openings 33 and 34 are respectively located in correspondence with the two openings 24 and 26 on the heel portion 20 of the outsole 18. The interchangeable heel 6 is attached to the heel portion 20 of the outsole 18 of the shoe 4 such that the exterior bottom surface 22 abuts the top surface 30 of the interchangeable heel 6.

The small threaded screw 8 is inserted into the opening 26 on the shoe 4 from the inside and threadedly engaged with the cylindrical sleeve 10 from the outside of the shoe 4. The cylindrical sleeve 10 is inserted into the narrow opening 34 at the top of the heel 6, so that the cylindrical sleeve 10 provides an anchor or orientation pin for the heel 6. This allows the heel portion 20 to be aligned with the heel 6 and also stabilizes the heel 6 from rotating during use once the heel 6 is mounted to the heel portion 20.

Figure 6:
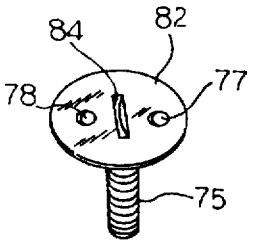
FIG. 6 is a perspective view of another large threaded bolt.

Referring to FIGS. 5 and 6, the large bolt 70 has a threaded shaft 75 and a widened disk-shaped top 76. The widened disk-shaped top 76 has a lower surface 80, an upper surface 82 and two small opposite holes 77 and 78 therethrough. The upper surface 82 has a horizontal narrow dent 84 which is located between the two small holes 77 and 78 wherein each small hole 77 or 78 is located on opposite sides of the horizontal narrow dent 84. The large bolt 70 is inserted into the opening 24 on the shoe 4 from the inside and threadedly engaged with the complementary cylindrical sleeve 81 which is press-fitted into the wide opening 33 at the top of the heel 6 and permanently attached thereto as part of the heel 6.

Referring again to FIG. 5, also used with this embodiment is an elongated flat shaft 86 which is utilized as a key or screwdriver for rotating the large bolt 70. The elongated flat shaft 86 is to be utilized in conjunction with a conventional key ring 94 and can be readily connected to the key ring 94. The key ring 94 comprises two collapsed coils that can be drawn apart so as to allow the insertion of the elongated flat shaft 86 and keys. The elongated flat shaft 86 is inserted upon and hangs from the key ring 94.

The elongated flat shaft 86 has one end 88 which is shaped as a handle for gripping and an opposite semi-circular end 90. The handle end 88 has an opening 92 for providing the key ring 94 to be suspended thereon. The semi-circular end 90 has two prongs 96 and 97 which extends outwardly therefrom and is equally spaced apart to allow the two prongs 96 and 97 to be inserted into the two small holes 77 and 78 on the widened disk-shaped top 76. The elongated flat shaft 86 acts like a screwdriver for rotating the large bolt 70 and is also small in size to therefore occupy a small amount of space and does not interfere with the normal operating and carrying of the key ring 94.

The heel 6 can be interchangeably detached and replaced by inserting the two prongs 96 and 97 of the elongated flat shaft 86 into the two small holes 77 and 78 of the widened disk-shaped top 76, thereby rotating the large bolt 70 counterclockwise to separate the heel 6 from the shoe 4 or clockwise to connect the heel 6 to the shoe 4.

The heel 6 can also be interchangeably detached and replaced by inserting a coin, for example a penny, within the horizontal narrow dent 84 of the widened disk-shaped top 76 of the large bolt 70, and turning the coin counterclockwise to separate the heel 6 from the shoe 4 or clockwise to connect the heel 6 to the shoe 4.

To assemble the shoe 4 with the interchangeable heel 6, the openings 24 and 26 are drilled through the padding within the shoe 4 and the outsole 18. The complementary cylindrical sleeve 81 is permanently mounted by press-fitting it to the wide opening 33 of the heel 6. The small screw 8 is placed inside the shoe above the interior bottom surface and extending through opening 26 and thereafter threadedly engaged with the cylindrical sleeve 10. The heel 6 is placed against the bottom of the outsole 18 so that the sleeve 10 is inserted into opening 34 of the heel 6. The large bolt 70 is placed inside the shoe 4 above the interior bottom surface and extending through opening 24 and thereafter threadedly engaged with the complementary cylindrical sleeve 81 within the wide opening 33 of the heel 6. The lower surface 80 of the widened disk-shaped top 76 lies against the interior bottom surface of the shoe 4. The widened disk-shaped top 76 is so thin that the person wearing the shoe 4 will not experience any discomfort. Also the insole has additional backing or padding so that the person will not feel the widened disk-shaped top 76 of the large bolt 70 once the insole is positioned downwardly inside the shoe 4 so that it covers the padding and the disk-shaped top 76 of the large bolt 70.

When one desires to remove the heel and replace it with a substitute heel, the insole is lifted away from the interior rear portion of the shoe so that the widened disk 20 shaped top 76 is exposed. The two prongs 96 and 97 of the elongated fiat shaft 86 are respectively inserted into the two small holes 78 and 77 of the widened disk-shaped top 76 and rotated in a counterclockwise direction until the threaded shaft 75 has been unscrewed from the cylindrical sleeve 81. At that point a substitute heel which also contains identical openings 33 and 34 is placed against the lower portion of the outsole 18 of the shoe so that sleeve 10 fits into opening 34. Also another cylindrical sleeve 81 is permanently mounted by press-fitting it within the opening 33 of the heel 6. The widened disk-shaped top 76 is rotated again in a clockwise direction so that threaded shaft 75 is screwed into the cylindrical sleeve 81 of the replacement heel. After the threading operation has been completed, the insole is pushed back over the assembly so that it is once again concealed and so that the shoe can be placed onto a woman's foot so that she can walk on it without feeling the widened disk-shaped top 76 of the large bolt 70.

The shoe 4 conforms to conventional forms of manufacture and is easy to use. The shoe 4 can be made of normal materials such as those used for conventional shoes, while the large bolt 70 is made of metal which can withstand the stress and impact at the juncture of the outsole 18 and the heel 6. The elongated flat shaft 86 is made of metal or any other suitable material.

Figure 7:
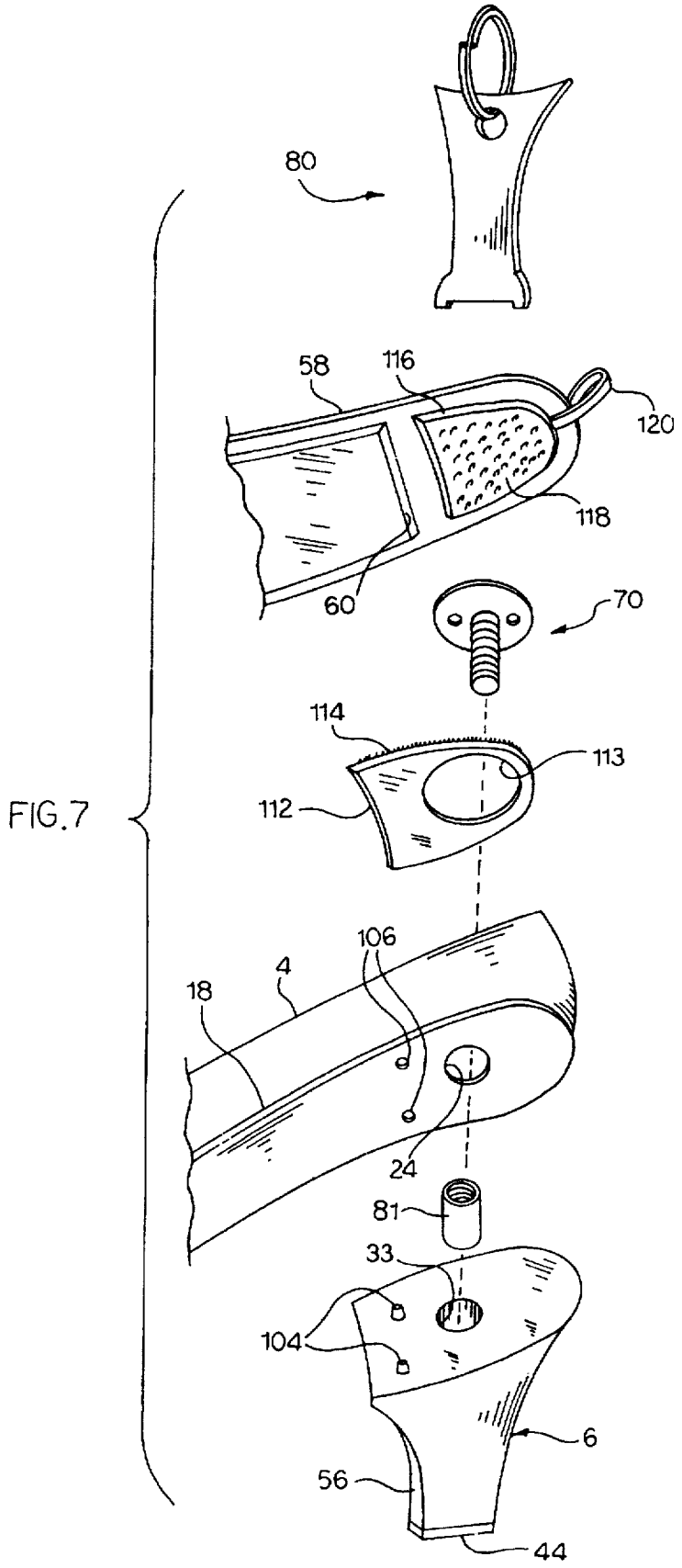
FIG. 7 is an exploded perspective view of still another embodiment of the shoe with the interchangeable heel.

Referring to FIGS. 7 through 9, there is shown an alternative embodiment of the present invention interchangeable shoe and the method of using the same. In this embodiment, the basic construction of the shoe 4 remains the same, with the insole 58, the padding 60 and the outsole 18. However, there are following changes in this embodiment.

First, the heel 6 is now made of a molded plastic material. It is a one-piece molded plastic with the protector piece 44 attached at the bottom. The protector piece 44 may be nailed to the one-piece plastic heel 6 by one or more small nails 102.

Second, instead of using a small sleeve 10 (shown in FIGS. 1, 2 and 5) protruding from the outsole 18 as the anchoring and orientation device for the heel, the molded heel now has one or more protrusions 104 which extend into the small holes 106 on the outsole 18 to serve as the anchoring and orientation device. The height of the small protrusions 104 is similar to the overall thickness of the outsole 18. Alternatively, the anchoring pins can protrude from the outsole and extending into corresponding mating holes in the heel. Therefore, under the present invention, the means for anchoring and orienting the heels can either be a pin on the heel inserted into a hole on the outsole, or a pin on the outsole inserted into a hole on the heel.

Third, two complementary hook and loop fasteners such as VELCRO® pieces 112 and 116 are used as the padding layers at the heel portion of the shoe 4. One hook or loop piece 112 is glued on the interior surface of the outsole and has a large opening 113 to accommodate the large bolt 70. Once the large bolt is in place, its top flat disc portion is flush with the hook or loop piece 112. The hook or loop piece 112 has a fastening surface 114 facing upwardly. The other corresponding mating hook or loop piece 114 is stitched to the underneath side of the insole 58 and has a complementary fastening surface 116 facing downwardly. The fastening surfaces of the corresponding hook and loop pieces will prevent the insole 58 from moving within the shoe 4. The overall thickness of the two hook and loop pieces is similar to the thickness of the padding layer 60 which is sandwiched between the insole 58 and the outsole 18.

Fourth, to facilitate the lifting of the insole 58 for the removal of the heel, a lift tab 120 is provided at the rear end of the insole 58. This will prevent the accidental injury to a user because the user no longer needs to use her finger nail to tear off the insole 58.

This embodiment of the present invention has certain advantages. First, the one-piece molded plastic construction of the heel increases the strength and durability of the heel. In addition, the protrusions from the molded plastic heel can be formed at the same time when the heel is molded, which eliminates the separate step of assembling the anchoring and orientation means. Furthermore, the hook and loop pieces serve both as padding at the heel portion of the shoe and the fastening means for preventing the insole from moving within the shoe. Additionally, the lifting tab provides an easy way to lift up the insole and unfasten the hook and loop pieces for interchanging the heel.

The method for a person to replace one interchangeable heel 6 with another interchangeable heel 6 on the shoe 4 is as follows. First, the person lifts the rear portion of the insole 58 by pulling the tab 120 to unfasten the fastening surface 118 of the hook or loop padding layer 116 affixed on the insole 58 from the complimentary fastening surface 114 of the corresponding hook or loop padding layer 112 affixed on the rear portion of the outsole 18, which exposes the head portion of the large bolt 70. Then the person unscrews the large bolt 70 by using the key 86 (or a coin) to detach the interchangeable heel 6 from the shoe 4. Further, the person anchors the other interchangeable heel to the shoe 4 by inserting the protrusions 104 into the small openings 106 on the outsole 18 respectively to secure proper orientation of the other interchangeable heel with respect to the shoe 4. Then the person screws the large bolt 70 back by using the key 86 (or a coin) to fasten the other interchangeable heel to the shoe 4. Finally, the person presses the insole 58 back to fasten the fastening surface 118 of the hook or loop padding layer 116 affixed on the insole 58 to the complimentary fastening surface 114 of the VELCRO® padding layer 112 affixed on the outsole 18. This covers the large bolt 70, provides a padding between the rear portions of the insole 58 and outsole 18, and prevents the rear portion of the insole 58 from moving within the shoe 4.

The main advantage of the present invention method is that a person can interchange the heel of her shoe by herself without using additional tools or go to a shoe shop. Therefore, when the person wants to replace a worn-out or damaged heel, or simply replace a heel with a different height, color, style or fashion, she can do it all by herself without any laborious or time-consuming work.

Defined in detail, the present invention is a method for a person to replace one interchangeable heel with another interchangeable heel on a shoe. The method comprising the following steps. First, lifting a rear portion of an insole of the shoe by pulling a tab provided thereon, to unfasten a fastening surface of a padding layer affixed on the insole from a complimentary fastening surface of a padding layer affixed on a rear portion of an outsole of the shoe, which exposes a head portion of a large bolt extending through a large opening on the outsole and fastened to the one interchangeable heel. Second, unscrewing the large bolt by engaging a key with the head portion of the large bolt to detach the one interchangeable heel from the shoe. Third, anchoring the other interchangeable heel to the shoe by inserting at least one protrusion on the other interchangeable heel into at least one small opening on the outsole to secure proper orientation of the other interchangeable heel with respect to the shoe. Fourth, rotating the large bolt by engaging the key with the head portion of the large bolt to fasten the other interchangeable heel to the shoe. Finally, pressing the insole back to fasten the fastening surface of the padding layer affixed on the insole to the complimentary fastening surface of the padding layer affixed on the outsole, which covers the head portion of the large bolt, provides a padding between the respective rear portions of the insole and outsole, and prevents the rear portion of the insole from moving within the shoe.

Defined broadly, the present invention is a method for a person to replace one interchangeable heel with another interchangeable heel on a shoe. The method comprising the following general steps. First, lifting a rear portion of an insole of the shoe to unfasten a fastening surface of a padding layer affixed on the insole from a complimentary fastening surface of a padding layer affixed on a rear portion of an outsole of the shoe, which exposes a large bolt extending through the outsole and fastened to the one interchangeable heel. Second, unscrewing the large bolt to detach the one interchangeable heel from the shoe. Third, anchoring the other interchangeable heel to the shoe by engaging an anchoring and orientation member on the other interchangeable heel with a complimentary anchoring and orientation member on the outsole to secure proper orientation of the other interchangeable heel with respect to the shoe. Fourth, rotating the large bolt to fasten the other interchangeable heel to the shoe. Finally, placing the insole back to fasten the fastening surface of the padding layer affixed on the insole to the complimentary fastening surface of the padding layer affixed on the outsole, which covers the large bolt, provides a padding between the respective rear portions of the insole and outsole, and prevents the rear portion of the insole from moving within the shoe.

Defined more broadly, the present invention is a method for a person to replace one interchangeable heel with another interchangeable heel on a shoe. The method comprising the following essential steps. First, lifting a rear portion of an insole of the shoe to expose a bolt extending through a rear portion of an outsole of the shoe and fastened to the one interchangeable heel. Then, unscrewing the bolt to detach the one interchangeable heel from the shoe. Further, anchoring the other interchangeable heel to the shoe to secure proper orientation of the other interchangeable heel with respect to the shoe. Afterwards, rotating the bolt to fasten the other interchangeable heel to the shoe. Finally, placing the insole back to cover the large bolt.

Alternatively defined in detail, the present invention is a shoe with an interchangeable heel which can be replaced by another interchangeable heel by a person. The shoe comprises the following components. First, the shoe has an insole having a rear portion with a lifting tab attached thereto. Second, the shoe has a padding layer affixed to the rear portion of the insole and having a downward facing fastening surface. Third, the shoe has an outsole having a rear portion with a large opening and at least one small opening. Fourth, the shoe has a padding layer affixed to the rear portion of the outsole and having an upward facing complimentary fastening surface, the padding layer having an opening corresponding to the large opening on the outsole. Fifth, the shoe has a large bolt extending through the outsole and fastened to the interchangeable heel. The interchangeable heel has a one-piece construction made of molded plastic, and has a top recess and at least one top protrusion. The at least one top protrusion is inserted into the at least one small opening on the outsole for anchoring and orienting the interchangeable heel with respect to the shoe. Lastly, the shoe has a sleeve having internal threads and installed into the top recess of the interchangeable heel, the large bolt threadedly engaged with the sleeve for fastening the interchangeable heel to the shoe.

Alternatively defined broadly, the present invention is a shoe with an interchangeable heel which can be replaced by another interchangeable heel by a person. The shoe comprises the following essential components. First, the shoe has an insole having a rear portion with a fastening member. Second, the shoe has an outsole having a rear portion with a complimentary fastening member fastened to the fastening member of the insole, where the fastening member of the insole and the fastening member of the outsole can be unfastened to remove the rear portion of the insole and expose a bolt extending through the outsole and fastened to the interchangeable heel. Third, the shoe has an interchangeable heel having means for receiving the screw and an anchoring and orientation member. Lastly, the outsole further has a complimentary anchoring and orientation member, where the anchoring and orientation member of the heel and the complimentary anchoring and orientation member of the outsole are engaged for anchoring and orienting the interchangeable heel with respect to the shoe.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shoe with an interchangeable heel which can be replaced by another interchangeable heel by a person, the shoe comprising:

a. an insole having a rear portion with a lifting tab attached thereto;

b. a padding layer affixed to said rear portion of said insole and having a downward facing fastening surface;

c. an outsole having a rear portion with a large opening and at least one small opening;

d. a padding layer affixed to said rear portion of said outsole and having an upward facing complimentary fastening surface, the padding layer having an opening corresponding to said large opening on said outsole;

e. a large bolt extending through said outsole and fastened to said interchangeable heel;

f. said interchangeable heel having a one-piece construction made of molded plastic, and having a top recess and at least one top protusion;

g. said at least one top protrusion inserted into said at least one small opening on said outsole for anchoring and orienting said interchangeable heel with respect to said shoe; and h. a sleeve having internal threads and installed into said top recess of said interchangeable heel, said large bolt threadedly engaged with said sleeve for fastening said interchangeable heel to said shoe;

i. whereby said person can replace said one interchangeable heel with said other interchangeable heel without going to a shoe shop.

2. The shoe as defined in claim 1 further comprising a key for screwing and unscrewing said large bolt.

3. A shoe with an interchangeable heel which can be replaced by another interchangeable heel by a person, the shoe comprising:

a. an insole having a rear portion with a fastening member;

b. an outsole having a rear portion with a complimentary fastening member fastened to said fastening member of said in sole, where said fastening member of said insole and said fastening member of said outsole can be unfastened to remove said rear portion of said insole and expose a bolt extending through said outsole and fastened to said interchangeable heel;

c. said interchangeable heel having means for receiving said bolt and an anchoring and orientation member; and d. said outsole further having a complimentary anchoring and orientation member, where said anchoring and orientation member of said heel and said complimentary anchoring and orientation member of said outsole are engaged for anchoring and orienting said interchangeable heel with respect to said shoe;

e. whereby said person can replace said one interchangeable heel with said other interchangeable heel without going to a shoe shop.

4. The shoe as defined in claim 3 further comprising a key for screwing and unscrewing said screw.

5. The shoe as defined in claim 3 wherein said means for receiving said bolt comprises a sleeve having internal threads and installed into a top recess on said interchangeable heel for having said large bolt threadedly engaged with said sleeve for fastening said interchangeable heel to said shoe.

6. The shoe as defined in claim 3 wherein said fastening member on said insole is a padding layer having a downward facing fastening surface, and said complimentary fastening member on said outsole is a padding layer having an upward facing complimentary fastening surface.

7. The shoe as defined in claim 3 wherein said anchoring and orientation member on said heel comprises a top protrusion on said heel, and said complimentary anchoring and orientation member on said outsole comprises an opening for receiving said top protrusion on said heel.

8. The shoe as defined in claim 3 wherein said heel has a one-piece construction made of molded plastic material.

* * * * *